US006773321B1

(12) United States Patent
Urquiaga

(10) Patent No.: US 6,773,321 B1
(45) Date of Patent: Aug. 10, 2004

(54) REMOTE CONTROL CONVERTIBLE TOY VEHICLE ASSEMBLY

(76) Inventor: Raul Urquiaga, 160 NW. 9th St., Boca Raton, FL (US) 33432

( * ) Notice: Subject to any disclaimer, the term of this patent is extended or adjusted under 35 U.S.C. 154(b) by 0 days.

(21) Appl. No.: 10/731,587

(22) Filed: Dec. 9, 2003

(51) Int. Cl.[7] ..... A63H 30/00
(52) U.S. Cl. ..... 446/45.4; 446/457
(58) Field of Search ..... 446/454, 455, 446/456, 457, 465, 470, 469, 471, 90–91, 93–95; 180/167, 169; 280/827, 1.188, 1.23

(56) References Cited

U.S. PATENT DOCUMENTS

| | | | | |
|---|---|---|---|---|
| 2,587,142 A | | 2/1952 | Gray et al. | |
| 2,870,566 A | | 1/1959 | Hofler | |
| 4,183,173 A | | 1/1980 | Ogawa | |
| 4,335,318 A | * | 6/1982 | Mabuchi et al. | 290/31 |
| 4,563,626 A | * | 1/1986 | Ohtake | 320/103 |
| 4,636,178 A | * | 1/1987 | Oda | 446/462 |
| 4,697,133 A | * | 9/1987 | Pergandis | 320/107 |
| 4,895,542 A | | 1/1990 | de Blanitza | |
| 4,969,851 A | | 11/1990 | Rasmussen | |
| 4,993,983 A | | 2/1991 | Kurita et al. | |
| 6,338,391 B1 | * | 1/2002 | Severinsky et al. | 180/65.2 |
| 6,679,752 B1 | * | 1/2004 | Reed, Sr. | 446/437 |

* cited by examiner

*Primary Examiner*—Derris H. Banks
*Assistant Examiner*—Jamila O Williams

(57) ABSTRACT

A remote control convertible toy vehicle assembly having detachable accessories has an axle connected to a toy vehicle chassis. A generator is detachably electrically connectable to a conventional battery. The generator is drivingly coupled to the axle and is for recharging the battery when the axle is rotating. A motor is detachably electrically connectable to the conventional battery and is drivingly coupled to the axle.

20 Claims, 2 Drawing Sheets

REMOTE CONTROL CONVERTIBLE TOY VEHICLE ASSEMBLY

BACKGROUND OF THE INVENTION

1. Field of the Invention

The present embodiment of the invention relates to a remote control convertible toy vehicle assembly for use in connection with toy vehicles. The remote control convertible toy vehicle assembly has particular utility in connection with convertible toy vehicle assemblies that are remote controlled, have removable and interchangeable parts and have a generator.

2. Description of the Prior Art

Remote control convertible toy vehicle assemblies are desirable for having a remote controlled vehicle that can have its appearance completely altered by changing accessory components on the vehicle. A need was felt for a remote controlled convertible toy vehicle which would have interchangeable parts for completely altering the look of the vehicle without having to purchase a new vehicle. Additionally, a need was felt for a remote controlled vehicle which has a generator for recharging the vehicle battery during use.

The use of toy vehicles is known in the prior art. For example, U.S. Pat. No. 4,183,173 to Ogawa discloses a toy assembly with interchangeable parts and detachable appendages includes a main body portion adapted to removably secure a front wheel unit, a rear wheel unit and a top cover. The body portion and removable components are provided with matching grooves and protrusions so as to allow interchangeable assembly of the parts by children in the course of play. The front wheel unit can provide both a cantilevered mounting of the axle and a displacement of the respective wheels in an operative position. The rear wheel can further incorporate a powered motor. In addition the rear wheel unit is provided with a joint assembly for the removable mounting of a trunk portion of a robot doll or a toy airplane. However, the Ogawa '173 patent does not have a remote control vehicle capable of interchanging parts and does not have a generator for recharging the vehicle battery during use to prolong battery life.

Similarly, U.S. Pat. No. 2,587,142 to Gray et al. discloses a toy automobile assembly kit having a variety of parts selectively combinable to provide toy automobiles of various models and including a chassis with detachably mounted wheels. A basic body structure is detachably mounted on the chassis. Rear fenders are detachably mounted to the body structure, forward cutaway portions of the rear fenders and a rear bumper are detachably mounted to the chassis. Front fenders are detachably mounted to the body structure. The rearwardly extending portions of the front fenders are projected in the forward cutaway portions of the rear fenders and are held against lateral displacement between the rear fenders and the body structure. A front bumper is detachably mounted to the basic body structure. However, the Gray et al. '142 patent does not have a remote control vehicle capable of interchanging parts and does not have a generator for recharging the vehicle battery during use to prolong battery life.

Further, U.S. Pat. No. 4,969,851 to Rasmussen discloses a toy vehicle with changing style features having opposed faces on the chassis has a pivotally movable piece carried by the chassis with the piece being biased by a bowed overcenter spring away from a playing surface on which the toy vehicle is supported on its wheels. The portion of the movable biased piece oriented away from the playing surface projects beyond the upper periphery of the wheels. When the toy vehicle flip over, impact upon the projecting portion of the movable biased piece overcomes the bias and pivots the piece so that an opposed portion projects out the other face of the chassis to present a differently styled vehicle. Trackway segments are also provided to effect and end over end flip over of the vehicle and a side or rollover flip of the vehicle. However, the Rasmussen '851 patent does not have a remote control vehicle capable of interchanging parts and does not have a generator for recharging the vehicle battery during use to prolong battery life.

Yet further, U.S. Pat. No. 2,870,566 to Hofler discloses a convertible wheeled toy vehicle having a chassis with a drivers cab and having a flat top surface behind the cab. A rear axle is connected to the chassis. A conversion member can be selectively assembled on the chassis in different positions to convert the vehicle for different uses. The conversion member can be assembled on the top surface to lie flat upon it and extend over its entire length. The member tapers to its front end and has side walls spaced at the rear of the member about the width of the top chassis surface. The drivers cab has in its rear wall an aperture to receive the front end of the member when the latter is assembled on the top surface. A set of aligned apertures in the side walls can be adapted to alternatively receive the removable rear axle when the conversion member is connected to the chassis in a position to serve as semi trailer like extension of the chassis. However, the Hofler '566 patent does not have a remote control vehicle capable of interchanging parts and does not have a generator for recharging the vehicle battery during use to prolong battery life.

Further still, U.S. Pat. No. 4,895,542 to de Blanitza discloses A toy automobile with attachments has slot-like formations on wide various surfaces to accommodate accessories and body elements which have circular clip elements snugly receivable removably in these recesses. The recesses can be paired with the recesses of each pair lying at right angles, e.g. in the form of a Greek cross. The accessories can include antenna, fuel can, windshield, headlight, car-transporter, car-flipping windlass, light, mirror and police elements, while the body elements can include caps for the back and driver's compartment, wheels and the like. However, the de Blanitza '542 patent does not have a remote control vehicle capable of interchanging parts and does not have a generator for recharging the vehicle battery during use to prolong battery life.

Lastly, U.S. Pat. No. 4,993,983 to Kurita et al. discloses a mobile toy having multiple siren sounds and body types includes a plurality of body shells, each being shaped to resemble a different vehicle type, a chassis to which any one of the plurality of body shells is selectively and detachably coupled; and siren sound generating means, mounted on the chassis, for producing a plurality of siren sounds, each being selectable to correspond to a selected and coupled one of the plurality of body shells. However, the Kurita et al. '983 patent does not have a remote control vehicle capable of interchanging parts and does not have a generator for recharging the vehicle battery during use to prolong battery life.

While the above-described devices fulfill their respective, particular objectives and requirements, the aforementioned patents do not describe a remote control convertible toy vehicle assembly that allows convertible toy vehicle assemblies that are remote controlled, have removable and interchangeable parts and have a generator. The Ogawa '173, Gray et al. '142, Rasmussen '851, Hofler '566, de Blanitza '542 and Kurita et al. '983 patents make no provision for a remote control vehicle capable of interchanging parts and does not have a generator for recharging the vehicle battery during use to prolong battery life.

Therefore, a need exists for a new and improved remote control convertible toy vehicle assembly which can be used for convertible toy vehicle assemblies that are remote controlled, have removable and interchangeable parts and have a generator. In this regard, the present embodiment of the invention substantially fulfills this need.

In this respect, the remote control convertible toy vehicle assembly according to the present embodiment of the invention substantially departs from the conventional concepts and designs of the prior art, and in doing so provides an apparatus primarily developed for the purpose of convertible toy vehicle assemblies that are remote controlled, have removable and interchangeable parts and have a generator.

SUMMARY OF THE INVENTION

In view of the foregoing disadvantages inherent in the known types of toy vehicles now present in the prior art, the present embodiment of the invention provides an improved remote control convertible toy vehicle assembly, and overcomes the above-mentioned disadvantages and drawbacks of the prior art. As such, the general purpose of the present embodiment of the invention, which will be described subsequently in greater detail, is to provide a new and improved remote control convertible toy vehicle assembly and method which has all the advantages of the prior art mentioned heretofore and many novel features that result in a remote control convertible toy vehicle assembly which is not anticipated, rendered obvious, suggested, or even implied by the prior art, either alone or in any combination thereof.

To attain this, the present embodiment of the invention essentially comprises an axle connected to a toy vehicle chassis. A generator is detachably electrically connectable to a conventional battery. The generator is drivingly coupled to the axle and is for recharging the battery when the axle is rotating. A motor is detachably electrically connectable to the conventional battery and is drivingly coupled to the axle.

There has thus been outlined, rather broadly, the more important features of the embodiment of the invention in order that the detailed description thereof that follows may be better understood and in order that the present contribution to the art may be better appreciated.

The present embodiment of the invention may also include a wireless remote control, a muffler lamp, a headlight, a taillight, a front end bumper, a hood scoop, a spoiler and a rim. There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved remote control convertible toy vehicle assembly that has all of the advantages of the prior art toy vehicles and none of the disadvantages.

It is another object of the present embodiment of the invention to provide a new and improved remote control convertible toy vehicle assembly that may be easily and efficiently manufactured and marketed.

An even further object of the present embodiment of the invention is to provide a new and improved remote control convertible toy vehicle assembly that has a low cost of manufacture with regard to both materials and labor, and which accordingly is then susceptible of low prices of sale to the consuming public, thereby making such remote control convertible toy vehicle assembly economically available to the buying public.

Still another object of the present embodiment of the invention is to provide a new remote control convertible toy vehicle assembly that provides in the apparatuses and methods of the prior art some of the advantages thereof, while simultaneously overcoming some of the disadvantages normally associated therewith.

Even still another object of the present embodiment of the invention is to provide a remote control convertible toy vehicle assembly for convertible toy vehicle assemblies that are remote controlled having removable and interchangeable parts.

Lastly, it is an object of the present embodiment of the invention is to provide a remote control convertible toy vehicle assembly for convertible toy vehicle assemblies that a generator to recharge the battery during use and prolong battery life.

These together with other objects of the embodiment of the invention, along with the various features of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
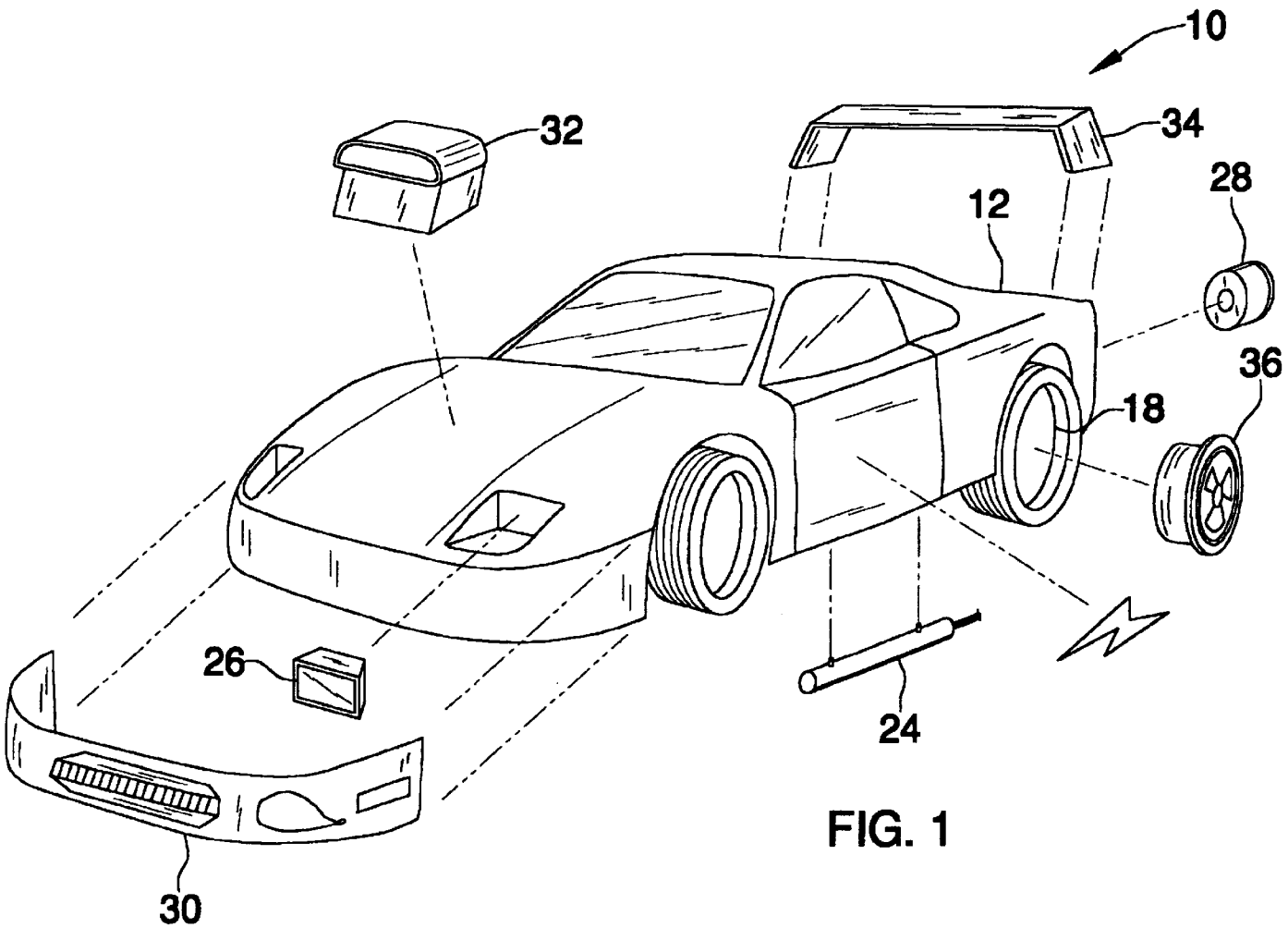
FIG. 1 is a top perspective view of the preferred embodiment of the remote control convertible toy vehicle assembly constructed in accordance with the principles of the present invention.
Figure 2:
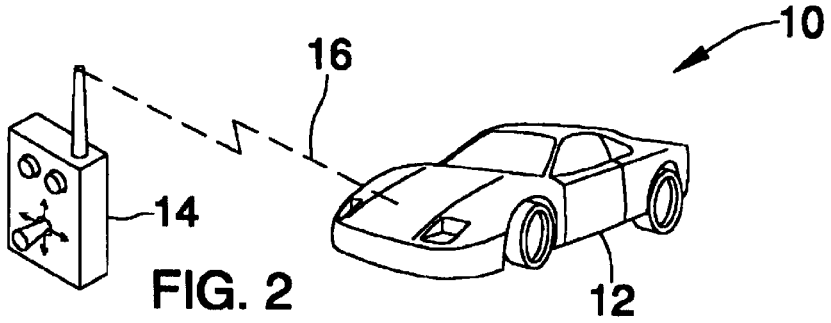
FIG. 2 is a top perspective view of the remote control convertible toy vehicle assembly of the present embodiment of the invention.
Figure 3:
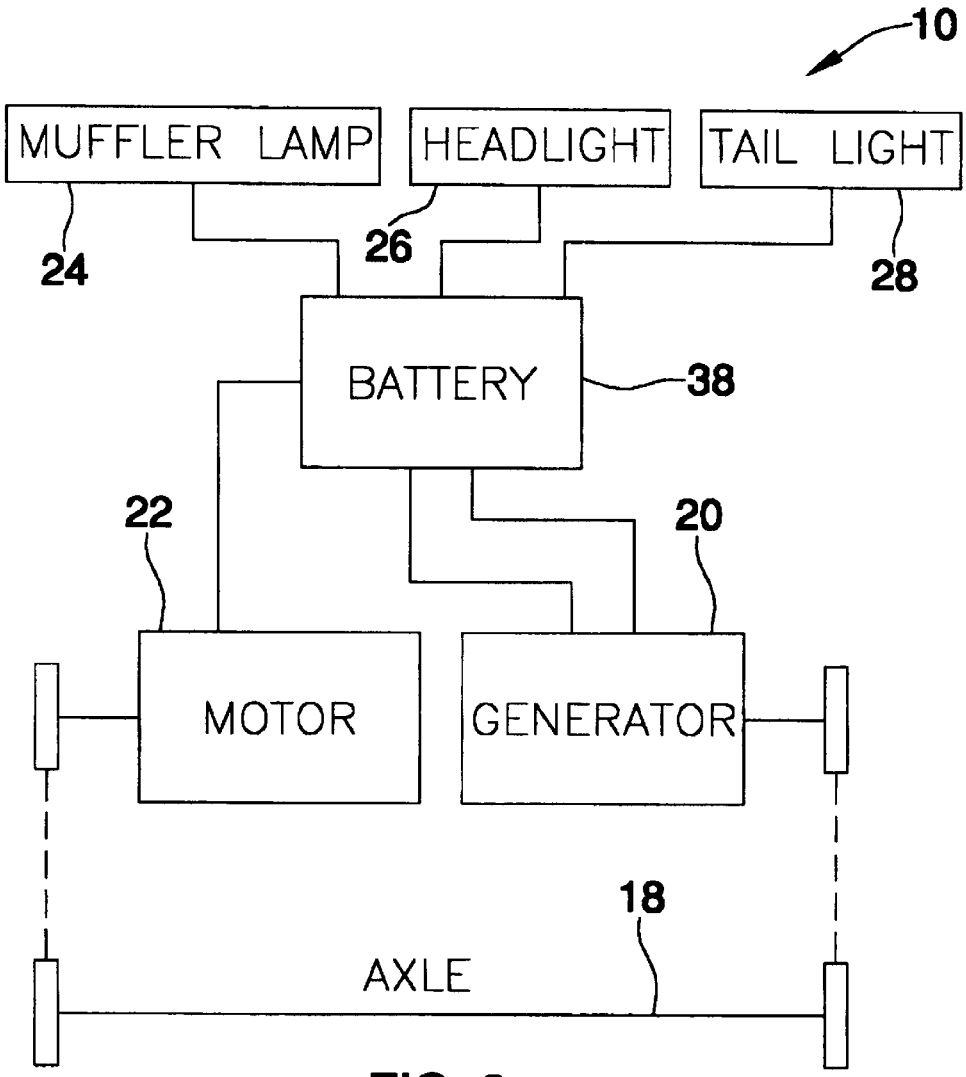
FIG. 3 is a wiring diagram view of the remote control convertible toy vehicle assembly of the present embodiment of the invention.

Referring now to the drawings, and particularly to FIGS. 1–3, a preferred embodiment of the remote control convertible toy vehicle assembly of the present invention is shown and generally designated by the reference numeral 10.

In FIG. 1, a new and improved remote control convertible toy vehicle assembly 10 of the present invention for convertible toy vehicle assemblies that are remote controlled, have removable and interchangeable parts and have a generator is illustrated and will be described. More particularly, the remote control convertible toy vehicle assembly 10 has a toy vehicle chassis 12 that is comprised of plastic. An axle 18 is connected to the toy vehicle chassis 12. A muffler lamp 24 is detachably connectable to the toy vehicle chassis 12. The muffler lamp 24 is detachably electrically connectable to a conventional battery 38 (shown in FIG. 3). A headlight 26 is detachably connectable to the toy vehicle chassis 12. The headlight 26 is detachably electrically connectable to the conventional battery 38. A taillight 28 is detachably connectable to the toy vehicle chassis 12. The taillight 28 is detachably electrically connectable to the conventional battery 38. A front end bumper 30 is detachably connectable to the toy vehicle chassis 12. A hood scoop 32 is detachably connectable to the toy vehicle chassis 12. A spoiler 34 is detachably connectable to the toy vehicle chassis 12. A rim 36 is detachably connectable to the axle 18.

In FIG. 2, the remote control convertible toy vehicle assembly 10 is illustrated and will be described. More particularly, the remote control convertible toy vehicle assembly 10 has the toy vehicle chassis 12 that is comprised of plastic. A wireless remote control 14 is capable of sending a remote control signal 16. The axle 18 (shown in FIG. 3) is connected to the toy vehicle chassis 12. A motor 22 (shown in FIG. 3) is drivingly coupled to the axle 18. The motor 22 is capable of receiving the remote control signal 16 and responding to the remote control signal 16.

In FIG. 3, the remote control convertible toy vehicle assembly 10 is illustrated and will be described. More particularly, the remote control convertible toy vehicle assembly 10 has the axle 18 connected to the toy vehicle chassis 12 (shown in FIG. 1). A generator 20 is detachably electrically connectable to the conventional battery 38. The generator 20 is drivingly coupled to the axle 18. The generator 20 is for recharging the battery 38 when the axle 18 is rotating. The motor 22 is detachably electrically connectable to the conventional battery 38. The motor 22 is drivingly coupled to the axle 18. The motor 22 is capable of receiving the remote control signal 16 (shown in FIG. 2) and responding to the remote control signal 16. The muffler lamp 24 is detachably electrically connectable to a conventional battery 38. The headlight 26 is detachably electrically connectable to the conventional battery 38. The taillight 28 is detachably electrically connectable to the conventional battery 38.

While a preferred embodiment of the remote control convertible toy vehicle assembly has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. For example, any suitable sturdy material such as metal may be used instead of the plastic accessories described. And although convertible toy vehicle assemblies that are remote controlled, have removable and interchangeable parts and have a generator have been described, it should be appreciated that the remote control convertible toy vehicle assembly herein described is also suitable for use as a robotic base.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

I claim:

1. A remote control convertible toy vehicle assembly comprising:

a toy vehicle chassis;

an axle connected to said toy vehicle chassis;

a generator detachably electrically connectable to a conventional battery, said generator drivingly coupled to said axle, said generator for recharging said battery when said axle is rotating; and a motor detachably electrically connectable to said conventional battery, said motor drivingly coupled to said axle.

2. The remote control convertible toy vehicle assembly of claim 1 further comprising:

a wireless remote control capable of sending a remote control signal; and wherein said motor is capable of receiving said remote control signal and responding to said remote control signal.

3. The remote control convertible toy vehicle assembly of claim 1 further comprising:

a muffler lamp detachably connectable to said toy vehicle chassis, said muffler lamp detachably electrically connectable to said conventional battery.

4. The remote control convertible toy vehicle assembly of claim 1 further comprising:

a headlight detachably connectable to said toy vehicle chassis, said headlight detachably electrically connectable to said conventional battery.

5. The remote control convertible toy vehicle assembly of claim 1 further comprising:

a taillight detachably connectable to said toy vehicle chassis, said taillight detachably electrically connectable to said conventional battery.

6. The remote control convertible toy vehicle assembly of claim 1 further comprising:

a front end bumper detachably connectable to said toy vehicle chassis.

7. The remote control convertible toy vehicle assembly of claim 1 further comprising:

a hood scoop detachably connectable to said toy vehicle chassis.

8. The remote control convertible toy vehicle assembly of claim 1 further comprising:

a spoiler detachably connectable to said toy vehicle chassis.

9. The remote control convertible toy vehicle assembly of claim 1 further comprising:

a rim detachably connectable to said axle.

10. The remote control convertible toy vehicle assembly of claim 1 wherein:

said chassis is comprised of plastic.

11. A remote control convertible toy vehicle assembly comprising:

a toy vehicle chassis;

a wireless remote control capable of sending a remote control signal;

an axle connected to said toy vehicle chassis;

a generator detachably electrically connectable to a conventional battery, said generator drivingly coupled to said axle, said generator for recharging said battery when said axle is rotating; and a motor detachably electrically connectable to said conventional battery, said motor drivingly coupled to said axle, said motor is capable of receiving said remote control signal and responding to said remote control signal.

12. The remote control convertible toy vehicle assembly of claim 11 further comprising:

a muffler lamp detachably connectable to said toy vehicle chassis, said muffler lamp detachably electrically connectable to said conventional battery.

13. The remote control convertible toy vehicle assembly of claim 12 further comprising:

a headlight detachably connectable to said toy vehicle chassis, said headlight detachably electrically connectable to said conventional battery.

14. The remote control convertible toy vehicle assembly of claim 13 further comprising:

a taillight detachably connectable to said toy vehicle chassis, said taillight detachably electrically connectable to said conventional battery.

15. The remote control convertible toy vehicle assembly of claim 14 further comprising:

a front end bumper detachably connectable to said toy vehicle chassis.

16. The remote control convertible toy vehicle assembly of claim 15 further comprising:

a hood scoop detachably connectable to said toy vehicle chassis.

17. The remote control convertible toy vehicle assembly of claim 16 further comprising:

a spoiler detachably connectable to said toy vehicle chassis.

18. The remote control convertible toy vehicle assembly of claim 17 further comprising:

a rim detachably connectable to said axle.

19. The remote control convertible toy vehicle assembly of claim 18 wherein:

said chassis is comprised of plastic.

20. A remote control convertible toy vehicle assembly comprising:

a toy vehicle chassis, said chassis is comprised of plastic;

a wireless remote control capable of sending a remote control signal;

an axle connected to said toy vehicle chassis;

a generator detachably electrically connectable to a conventional battery, said generator drivingly coupled to said axle, said generator for recharging said battery when said axle is rotating;

a motor detachably electrically connectable to said conventional battery, said motor drivingly coupled to said axle, said motor is capable of receiving said remote control signal and responding to said remote control signal;

a muffler lamp detachably connectable to said toy vehicle chassis, said muffler lamp detachably electrically connectable to said conventional battery;

a headlight detachably connectable to said toy vehicle chassis, said headlight detachably electrically connectable to said conventional battery;

a taillight detachably connectable to said toy vehicle chassis, said taillight detachably electrically connectable to said conventional battery;

a front end bumper detachably connectable to said toy vehicle chassis;

a hood scoop detachably connectable to said toy vehicle chassis;

a spoiler detachably connectable to said toy vehicle chassis; and a rim detachably connectable to said axle.

* * * * *